US009126437B2

(12) United States Patent
Komatsu et al.

(10) Patent No.: US 9,126,437 B2
(45) Date of Patent: Sep. 8, 2015

(54) INK JET RECORDING APPARATUS

(71) Applicant: CANON KABUSHIKI KAISHA, Tokyo (JP)

(72) Inventors: Hiroaki Komatsu, Yokohama (JP); Masaya Uetsuki, Yokohama (JP); Toshimitsu Danzuka, Tokyo (JP); Masataka Kato, Yokohama (JP); Tsuyoshi Ibe, Yokohama (JP); Asako Tomida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/258,690

(22) Filed: Apr. 22, 2014

(65) Prior Publication Data

US 2014/0313260 A1 Oct. 23, 2014

(30) Foreign Application Priority Data

Apr. 23, 2013 (JP) ..... 2013-090805

(51) Int. Cl.
*B41J 2/165* (2006.01)
*B41J 11/00* (2006.01)

(52) U.S. Cl.
CPC ..... *B41J 11/0085* (2013.01); *B41J 2/16526* (2013.01)

(58) Field of Classification Search
None
See application file for complete search history.

(56) References Cited

U.S. PATENT DOCUMENTS

| | | | | |
|---|---|---|---|---|
| 6,761,430 | B2 | 7/2004 | Kinoshita | |
| 8,371,677 | B2 | 2/2013 | Fukasawa | |
| 2002/0054185 | A1 | 5/2002 | Kinoshita | |
| 2003/0038856 | A1 * | 2/2003 | Vega et al. | 347/23 |
| 2005/0270323 | A1 | 12/2005 | Oshio | |

FOREIGN PATENT DOCUMENTS

| | | | |
|---|---|---|---|
| CN | 1488504 | A | 4/2004 |
| CN | 1488505 | A | 4/2004 |
| CN | 101811394 | A | 8/2010 |
| CN | 102407662 | A | 4/2012 |
| JP | 2000-272110 | A | 10/2000 |
| JP | 2007-253407 | A | 10/2007 |
| JP | 2010-105348 | A | 5/2010 |

* cited by examiner

*Primary Examiner* — Alejandro Valencia
(74) *Attorney, Agent, or Firm* — Canon U.S.A., Inc., IP Division

(57) ABSTRACT

In the case where a preliminary discharge operation is always performed at a position that is spaced apart from a recording area, the time taken for a recording head to be moved to a preliminary discharge position is increased, and this results in a decrease in throughput. In the case where it is determined that a leading end or a trailing end of a recording medium is located on a platen, positions at which the distance from an end of a recording medium to a recording head with respect to a moving direction is not smaller than a threshold are determined as preliminary discharge positions, and the recording head is controlled to perform a preliminary discharge operation.

7 Claims, 9 Drawing Sheets

FIG. 4A1
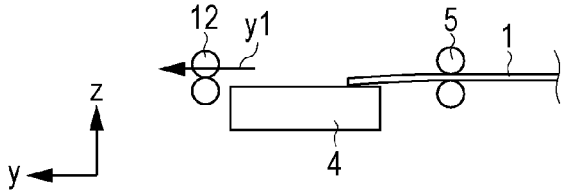
FIG. 4A2
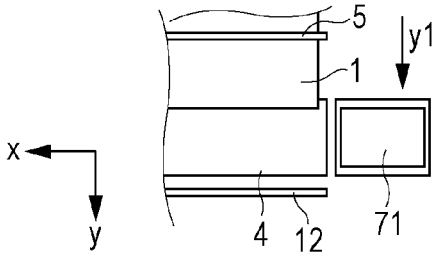
FIG. 4B1
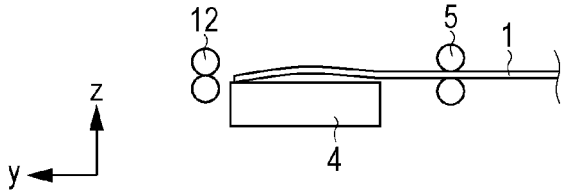
FIG. 4B2
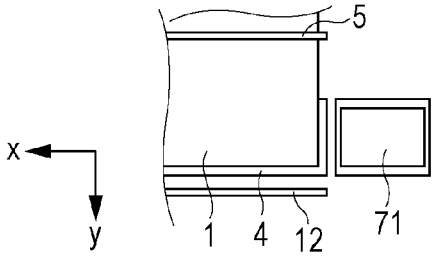
FIG. 4C1
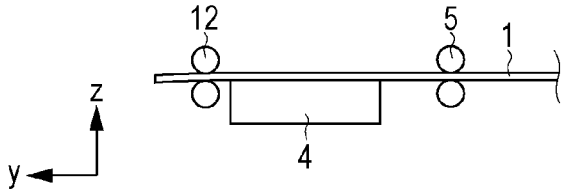
FIG. 4C2
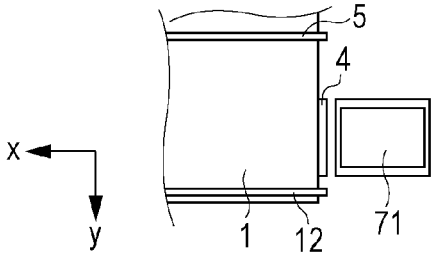

INK JET RECORDING APPARATUS

BACKGROUND

1. Field

Aspects of the present invention generally relate to an ink jet recording apparatus.

2. Description of the Related Art

In an ink jet recording apparatus, when an ink discharge operation is performed, dispersion of very small ink particles that do not land on a recording medium and that are so-called ink mist occurs other than dispersion of main droplets that land on the recording medium. Ink mist is dispersed by air flow, which is generated in a recording apparatus as a result of a movement of a carriage and the like, and attached to various places in such a manner as to contaminate the interior of the recording apparatus. In addition, ink mist is also dispersed on the backside of a recording medium and contaminates the rear surface of the recording medium. This phenomenon will be hereinafter referred to as back staining.

In an ink jet recording apparatus, in the case where a recording operation is not performed for a predetermined period of time, ink in a discharge port of a recording head becomes thick and may not be normally discharged. Therefore, even during a recording operation, a preliminary discharge operation is performed at regular intervals, and ink in a discharge port is discharged at regular intervals, so that the discharge port is maintained in a good state. Such a preliminary discharge operation is performed at a preliminary discharge position, which is outside a recording area, and in a cap, and thus, a large amount of ink mist is generated as compared with the case of a recording operation. Japanese Patent Laid-Open No. 2010-105348 discloses a configuration in which an amount of ink mist is reduced by performing a preliminary discharge operation at a cap position that is spaced apart from a recording area.

However, in the case where a preliminary discharge operation is always performed at a position that is spaced apart from a recording area in order to reduce the amount of ink mist at the time of a preliminary discharge operation, the time taken for a recording head to be moved to a preliminary discharge position is increased, and this results in a decrease in throughput.

SUMMARY

Aspects of the present invention generally provide an ink jet recording apparatus capable of preventing a rear surface of a recording medium from being contaminated while reducing a decrease in throughput.

According to an aspect of the present invention, an inkjet recording apparatus includes a carriage that moves in a first direction and on which a recording head that performs recording by discharging ink is mounted, a transport unit that transports a recording medium in a second direction that crosses to the first direction, and a preliminary discharge unit configured to cause the recording head to perform preliminary discharge. The preliminary discharge unit changes a position of the recording head in the first direction based on a position of the recording medium in the second direction when the recording head performs preliminary discharge.

Further features of the present disclosure will become apparent from the following description of exemplary embodiments with reference to the attached drawings.

BRIEF DESCRIPTION OF THE DRAWINGS

FIGS. 4A1 to 4C2 are diagrams illustrating a gap between a recording medium and a platen.

DESCRIPTION OF THE EMBODIMENTS

Figure 1A:
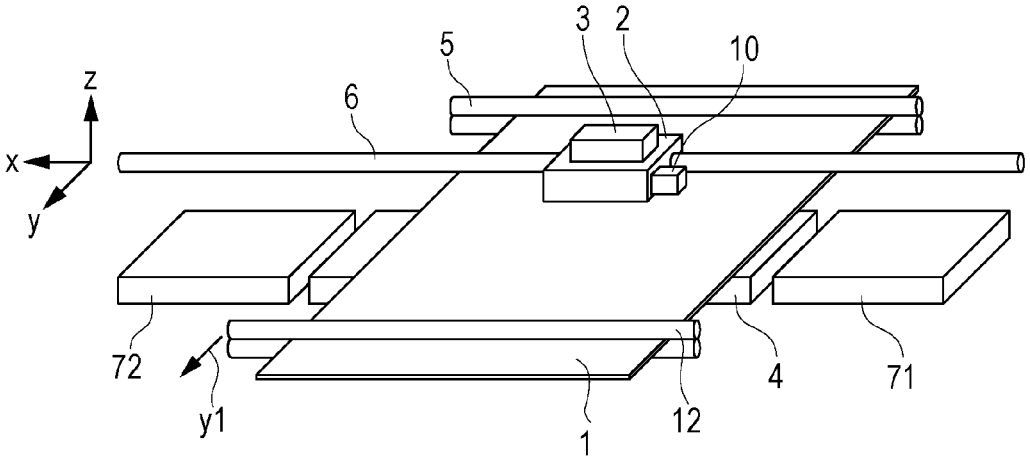
FIG. 1A is a perspective view schematically illustrating an ink jet recording apparatus according to a first embodiment.

Ink jet recording apparatuses perform recording operations on recording media such as roll sheets or cut sheets by discharging ink. Such ink jet recording apparatuses are used in office machines such as a printer, a copying machine, and a facsimile machine and in industrial production equipment and the like. Recording can be performed on various recording media made of paper, thread, fibers, cloth, leather, metal, plastic, glass, wood, ceramics, and the like by using such an ink jet recording apparatus.

The term "recording" as used herein means to add images that have meanings such as characters and figures to a recording medium and also means to add images that do not have meanings such as patterns to a recording medium.

In addition, the term "ink" shall be broadly interpreted and refers to a liquid that is used in formation of images, designs, patterns, and the like, processing of a recording medium, or processing of ink or a recording medium by being applied on a recording medium.

Exemplary embodiments will be described below with reference to the drawings. Note that, in the following description, elements that have the same functions are denoted by the same reference numerals in the drawings, and descriptions thereof may sometimes be omitted.

First Embodiment

Schematic Configuration of Apparatus Main Body

FIG. 1A is a schematic perspective view of a recording apparatus main body of an ink jet recording apparatus that performs a recording operation on a recording medium 1. The ink jet recording apparatus of the present embodiment is a so-called serial-type ink jet recording apparatus that performs a recording operation by causing a recording head that has a discharge-port surface, in which a plurality of discharge ports that discharge ink are formed, to reciprocate in a width direction of a recording medium (the x direction). A platen 4 (a support member) is disposed at a position facing a discharge-port surface of a recording head 3 in such a manner as to extend over a movement area of the recording head 3. A recording operation is performed in a state where the recording medium 1 is supported by the platen 4.

The recording medium 1 is transported in the y1 direction perpendicular to the x direction, by a transport unit that includes transport rollers 5, sheet ejection rollers 12, and the like. The transport rollers 5 are disposed upstream of the platen 4 in a transport direction of the recording medium 1. The sheet ejection rollers 12 are disposed downstream of the platen 4 in the transport direction. Note that the sheet ejection rollers 12 are not essential elements in the present embodiment.

The recording head 3 is removably mounted on a carriage 2. The carriage 2 reciprocates along the x direction. More specifically, the carriage 2 is movably supported along a guide shaft 6 that is disposed along the x direction, and the carriage 2 is fixed to an endless belt (not illustrated) that moves parallel to the guide shaft 6. The endless belt performs a reciprocating motion by a driving force of a carriage motor (a CR motor) 114 and causes the carriage 2 to reciprocate in the x direction.

Such an operation of transporting the recording medium 1 that is to be performed by the transport unit and a recording operation that is performed while moving the recording head 3, which is mounted on the carriage 2, in a direction crossing to the transport direction of the recording medium 1 are repeated, so that image recording is performed.

In the ink jet recording apparatus, a preliminary discharge operation in which ink that is not used for recording is discharged from the discharge ports at regular intervals is performed in order to recover the state of each of the discharge ports by removing ink that has become thick as a result of evaporation of moisture from the discharge ports and air bubbles in the discharge ports. A first preliminary discharge ink receiving portion 71 and a second preliminary discharge ink receiving portion 72 that are disposed outside a recording area are used for receiving ink that is discharged by such a preliminary discharge operation. In addition, a recovery processing device 7 (not illustrated) that recovers the ink discharge state of the recording head 3 and maintains the ink discharge state of the recording head 3 can be provided.

An end-position sensor 10 such as an optical sensor that can sense the position of an end of a recording medium with respect to a movement direction (the x direction) is mounted on the carriage 2. The passage of a leading end and a trailing end of the recording medium 1 with respect to the transport direction (the y direction) can be sensed by using the end-position sensor 10. Such an operation of sensing the leading end of the recording medium 1 is performed by moving the end-position sensor 10 to an area through which the recording medium 1 passes.

Note that, as a method of sensing the position of the leading end of the recording medium 1, the position of the leading end of the recording medium 1 may be detected by using a sensor that is disposed independently of the carriage 2, or a sheet feed sensor that can sense the passage of the leading end and the trailing end of the recording medium 1 may be disposed upstream of the transport rollers 5.

Figure 1B:
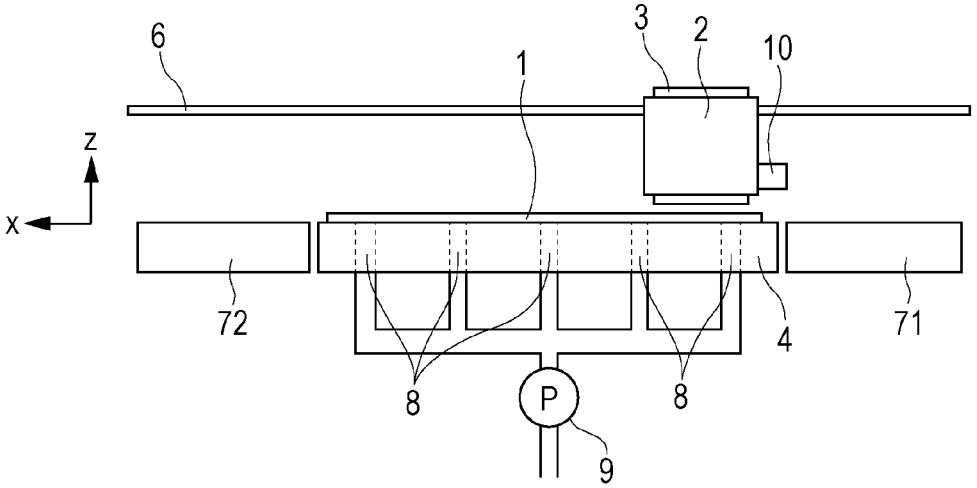
FIG. 1B is a plan view schematically illustrating the ink jet recording apparatus according to the first embodiment.

FIG. 1B is a schematic xz plan view of the recording apparatus main body of the ink jet recording apparatus. A plurality of suction ports 8 that are connected to the same suction pump 9 are formed in the platen 4. The recording medium 1 can be held on the platen 4 by being suctioned by the suction pump 9. An ink landing position can be precisely controlled by performing a recording operation while the recording medium 1 is held on the platen 4.

Note that, as a method of bringing the recording medium 1 into close contact with the platen 4, a configuration in which the recording medium 1 is pressed by a pressing member in a direction toward the platen 4 may be employed. Alternatively, the recording medium 1 needs not be brought into close contact with the platen 4.

Control System

Figure 2:
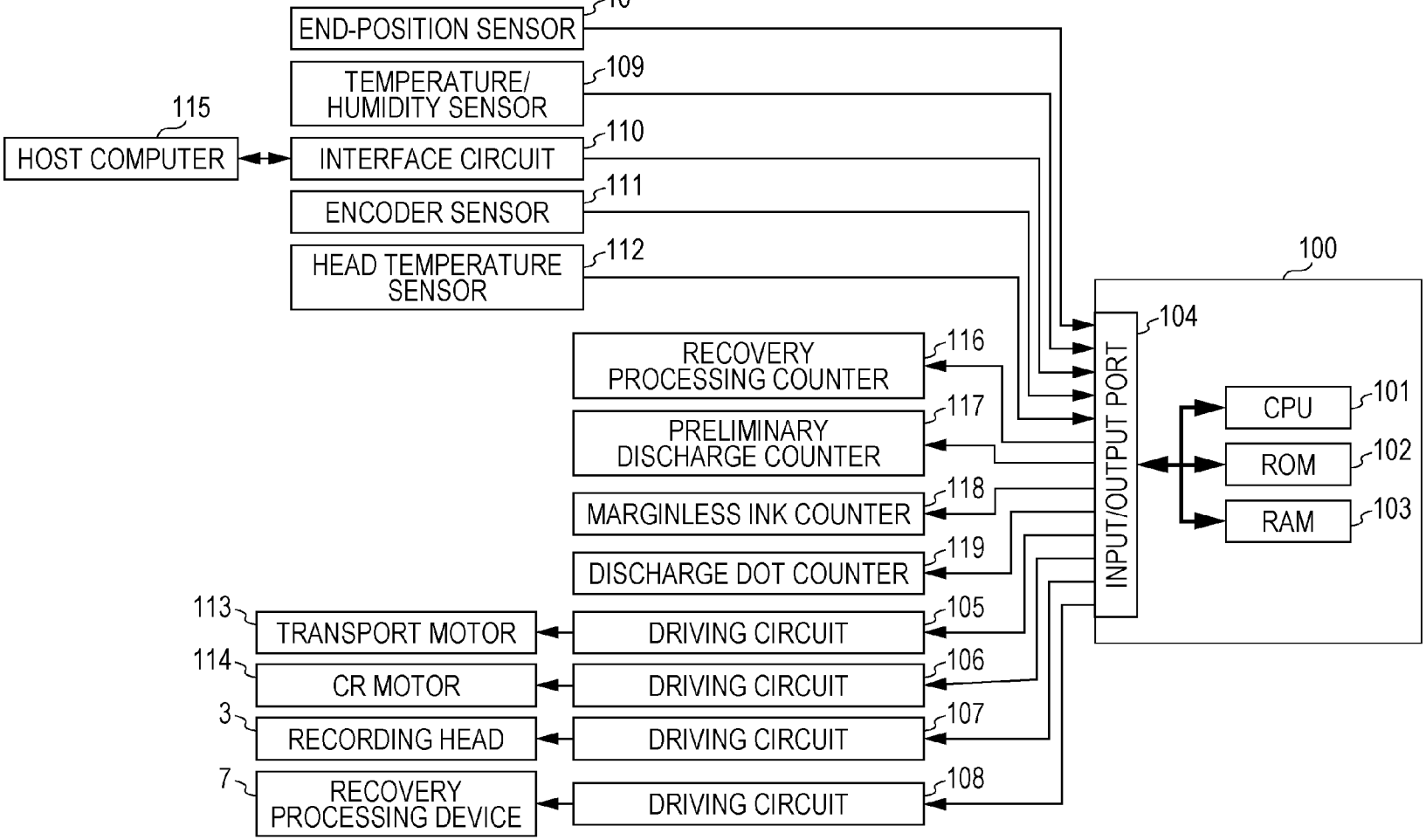
FIG. 2 is a block diagram illustrating the configuration of a control system that is mounted on a main body of the ink jet recording apparatus.

FIG. 2 is a block diagram illustrating an example of a configuration of a control system (a control unit) that is mounted on the recording apparatus main body of the ink jet recording apparatus of the present embodiment. In FIG. 2, a main control unit is indicated by a reference numeral 100. The main control unit 100 includes a central processing unit (CPU) 101 that performs processing operations such as calculation, control, determination, and settings. In addition, the main control unit 100 includes a read only memory (ROM) 102, a random access memory (RAM) 103, an input/output port 104, and the like. A control program, which is to be executed by the CPU 101, and so forth are stored in the ROM 102. The RAM 103 is used as a buffer in which binary recording data indicating discharge/non-discharge of ink is stored, a work area for processing that is performed by the CPU 101, or the like.

Driving circuits 105, 106, 107, and 108 of a transport motor 113 that drives the transport rollers 5 and the sheet ejection rollers 12, the carriage motor (the CR motor) 114, the recording head 3, and the like are connected to the input/output port 104. The driving circuits 105, 106, 107, and 108 are controlled by the main control unit 100. A head temperature sensor 112 that detects a temperature of the recording head 3, an encoder sensor 111 that is fixed to the carriage 2, a temperature/humidity sensor 109 that senses the temperature and humidity that are the environments in which the recording apparatus main body is used are connected to the input/output port 104. In addition, a sensor such as the end-position sensor 10 is also connected to the input/output port 104. The main control unit 100 is connected to a host computer 115 via an interface circuit 110.

A recovery processing counter that counts the amount of ink in the case where the ink is forcibly discharged from the recording head 3 by the recovery processing device 7 is indicated by a reference numeral 116. A preliminary discharge counter that counts the number of preliminary discharges that are performed before recording is started, when the recording is ended, and during the recording is indicated by a reference numeral 117. A marginless ink counter that counts ink that is recorded in an area outside the recording area when marginless recording is performed is indicated by a reference numeral 118, and a discharge dot counter that counts ink that is discharged during recording is indicated by a reference numeral 119.

A recording operation that is executed by the ink jet recording apparatus that has the above-described configuration will be described. When recording data is received from the host computer 115 via the interface circuit 110, the recording data is expanded into a buffer of the RAM 103. When a recording operation is instructed, the transport rollers 5 operate, and the recording medium 1 is transported to a position facing the recording head 3. In this case, the end-position sensor 10, which is mounted on the carriage 2, senses the passage of the leading end of the recording medium 1 and outputs a sensing signal to the main control unit 100. The main control unit 100 determines the position of the leading end of the recording medium 1 with respect to the transport direction on the basis of the sensing signal.

The carriage 2 moves along the guide shaft 6 in the x direction. Along with a movement of the carriage 2, ink droplets are discharged from the recording head 3, and an image of one band is recorded in the recording medium 1. After that, the recording medium 1 is transported by only a distance corresponding to one band by the transport unit in the transport direction. The above-described operation is repeated, so that a predetermined image is formed on the recording medium 1. Note that, here, an example in which an image of one band is recorded during the period when the carriage 2 is moving in one direction in the x direction has been described, an image of one band may be recorded as a result of a plurality of movements of the carriage 2 that include movements of the carriage 2 in the one direction and the opposite direction.

The main control unit 100 counts pulse signals that are output from the encoder sensor 111 along with movements of the carriage 2, so that the position of the carriage 2 is detected. In other words, the encoder sensor 111 outputs pulse signals to the main control unit 100 by detecting detection portions that are formed with a predetermined interval therebetween in an encoder film (not illustrated) that is disposed along the x direction. The main control unit 100 detects the position of the carriage 2 by counting such pulse signals. Movements of the carriage 2 to a home position and other positions are made on the basis of signals from the encoder sensor 111.

Preliminary Discharge Operation

Figure 3:
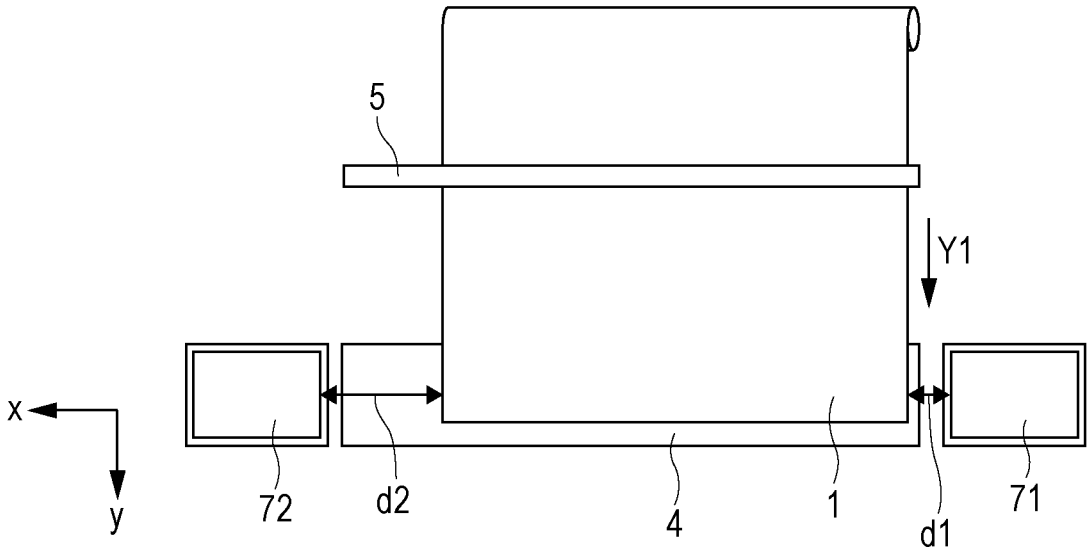
FIG. 3 is a top view schematically illustrating the ink jet recording apparatus.

Preliminary discharge positions (the first preliminary discharge ink receiving portion 71 and the second preliminary discharge ink receiving portion 72) at the ends of the recording medium 1 will now be described in detail with reference to FIG. 3. FIG. 3 is a schematic top view of the main body of the ink jet recording apparatus.

As illustrated in FIG. 3, the first preliminary discharge ink receiving portion 71 and the second preliminary discharge ink receiving portion 72 are disposed outside the recording area of the recording medium 1 in which a recording operation is performed. Note that the first preliminary discharge ink receiving portion 71 and the second preliminary discharge ink receiving portion 72 may be disposed on the platen 4 as long as the first preliminary discharge ink receiving portion 71 and the second preliminary discharge ink receiving portion 72 are disposed outside the recording area. Here, the distance from one of ends of the recording medium 1 to an end of the first preliminary discharge ink receiving portion 71 with respect to the x direction is indicated by a reference numeral d1, and the distance from the other one of the ends of the recording medium 1 to an end of the second preliminary discharge ink receiving portion 72 with respect to the x direction is indicated by a reference numeral d2. The recording medium 1 may be a rolled recording medium such as that illustrated in FIG. 3 or may be a cut sheet.

The ink jet recording apparatus performs a preliminary discharge operation on the first preliminary discharge ink receiving portion 71 and the second preliminary discharge ink receiving portion 72 for each scanning, so that a discharging failure and the like due to thickening of ink in the discharge ports are prevented from occurring. The number of preliminary discharges that are discharged by a preliminary discharge operation is controlled in accordance with the sizes of a recorded image and the recording medium 1 in a scanning direction related to an intermission period and with recording environment conditions, and that is, a fixed number of preliminary discharge operations are performed regardless of the position of the recording medium 1 with respect to the transport direction.

In the studies that were conducted by the inventors, it was found that the degree of back staining of a recording medium due to ink mist that is generated as a result of such a preliminary discharge operation was particularly high in a leading end portion of a recording medium. This is because part of an area in a leading end portion of a recording medium is separated from a platen due to the influence of friction that is generated between the leading end of the recording medium and the platen and the curl of the recording medium, a gap is generated between the recording medium and the platen, and ink mist enters the gap. This will be described in detail below with reference to FIGS. 4A1 to 4C2.

FIGS. 4A1 to 4C2 are schematic plan views of the main body of the ink jet recording apparatus. FIGS. 4A1, 4B1, and 4C1 are yz plan views, and FIGS. 4A2, 4B2, and 4C2 are xy plan views. FIGS. 4A1 and 4A2, FIGS. 4B1 and 4B2, and FIGS. 4C1 and 4C2 respectively illustrate the states of the ink jet recording apparatus at the same time.

As illustrated in FIGS. 4A1 and 4A2, the recording medium 1 is transported by the transport rollers 5 in the y1 direction, and the leading end of the recording medium 1 is moved onto the platen 4. Next, as illustrated in FIG. 4B1, part of the recording medium 1 on the platen 4 is separated from the platen 4 due to friction that is generated between the leading end of the recording medium 1 and the platen 4 and the curl of the recording medium 1, and a gap is generated between the recording medium 1 and the platen 4. In this case, when a preliminary discharge operation is performed in the first preliminary discharge ink receiving portion 71, which is illustrated in FIG. 4B2, there is a case where ink mist that is generated as a result of the preliminary discharge operation enters the above-mentioned gap depending on a position in the first preliminary discharge ink receiving portion 71, and the ink mist contaminates the rear surface of the recording medium 1 in an area in the leading end portion of the recording medium 1.

On the other hand, as illustrated in FIGS. 4C1 and 4C2, when the leading end of the recording medium 1 is moved to a position downstream of the platen 4, the gap, which is generated between the recording medium 1 and the platen 4, is eliminated as a result of the recording medium 1 being held on the platen 4 by the plurality of suction ports 8 or is eliminated by the weight of a portion of the recording medium 1 that projects from the platen 4. In this state, even if a preliminary discharge operation is performed at any position in the first preliminary discharge ink receiving portion 71, which is illustrated in FIG. 4C2, ink mist will not enter an area between the recording medium 1 and the platen 4, and thus, the rear surface of the recording medium 1 will not be contaminated.

That is to say, the rear surface of the recording medium 1 gets contaminated only during the period when the leading end of the recording medium 1 is located on the platen 4. Therefore, in the present embodiment, a preliminary discharge operation is performed at a position that is sufficiently spaced apart from a side end of the recording medium 1 during the period when the leading end of the recording medium 1 is located on the platen 4. After the leading end of the recording medium 1 has been moved to a position downstream of the platen 4, a preliminary discharge operation is performed at a position that is closest to a side end of the recording medium 1. A position at which a preliminary discharge operation is to be performed is changed in accordance with the position of the leading end of the recording medium 1 in the manner described above, so that the time taken for the recording head 3 to be moved to a preliminary discharge position can be reduced while the recording medium 1 is prevented from being contaminated by ink mist, and a decrease in throughput can be reduced.

Determination of preliminary discharge positions will now be described in detail with reference to FIG. 5A.

Figure 5A:
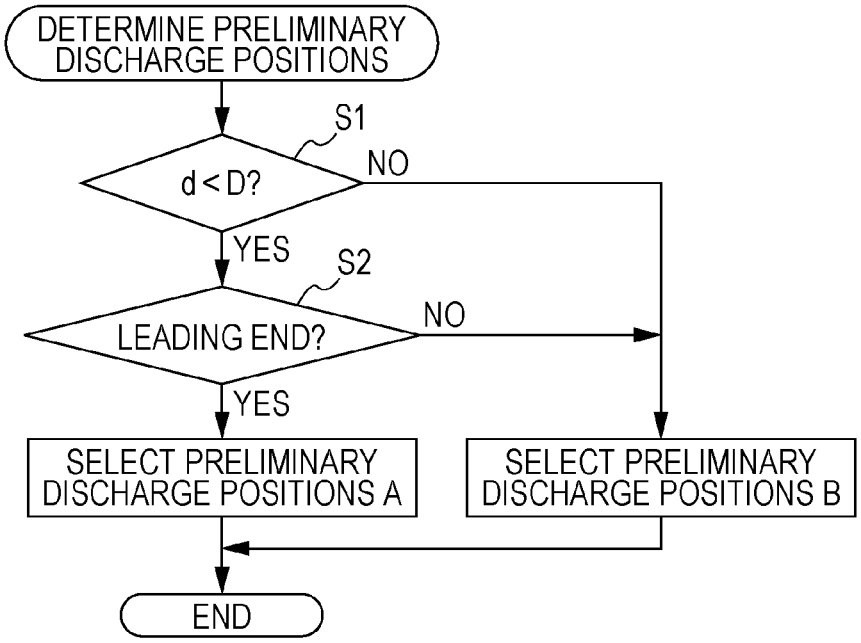
FIG. 5A is a flowchart of a process of determining preliminary discharge positions.

FIG. 5A is a flowchart of a process of determining preliminary discharge positions. The distance from an end of a recording medium to a preliminary discharge ink receiving portion with respect to the x direction is indicated by a reference letter d. In other words, in FIG. 3, the reference numeral d1 indicates the distance from one of the ends of the recording medium 1 to the first preliminary discharge ink receiving portion 71 with respect to the x direction, and the reference numeral d2 indicates the distance from the other one of the ends of the recording medium 1 to the second preliminary discharge ink receiving portion 72 with respect to the x direction. Such a process of determining preliminary discharge positions is performed in both the first preliminary discharge ink receiving portion 71 and on the second preliminary discharge ink receiving portion 72.

First, when preliminary discharge position determination control is started, the distance d between an end of a recording medium and an end of a preliminary discharge ink receiving portion on which a preliminary discharge operation will be performed with respect to the x direction is compared with a threshold D (a predetermined value) (S1). Here, the threshold D indicates a minimum distance at which ink mist that is generated as a result of a preliminary discharge operation will not be dispersed on the backside of the recording medium even in an area in a leading end portion of the recording medium.

When the distance d is smaller than the threshold D (d<D) in S1, it is determined that there is a possibility of back staining occurring when a preliminary discharge operation is performed at a position in the preliminary discharge ink receiving portion that is closest to the recording medium, and the process moves on to S2. When the distance d is not smaller than the threshold D (dD), it is determined that back staining will not occur even if a preliminary discharge operation is performed at any position in the preliminary discharge ink receiving portion, and preliminary discharge positions B that are close to ends of the recording medium and to each of which a travel distance of the recording head 3 is small are selected in order to reduce a decrease in throughput.

In S2, it is determined whether or not the leading end of the recording medium 1 with respect to the transport direction is located on the platen 4 when a preliminary discharge operation is performed. The position of the leading end of the recording medium can be obtained on the basis of the timing when the leading end of the recording medium 1 is sensed by the end-position sensor 10. More specifically, the position of the leading end of the recording medium 1 can be determined from a rotation amount of the transport rollers 5 after the leading end of the recording medium 1 has been sensed.

In S2, in the case where it is determined that the leading end of the recording medium is located on the platen, preliminary discharge positions A that are far from ends of the recording medium by a distance larger than the above-described threshold D are selected. In the case where it is determined that the leading end of the recording medium is not located on the platen, since back staining will not occur even if the distance d is smaller than the threshold D, the preliminary discharge positions B, which are close to the ends of the recording medium and to each of which a travel distance of the recording head is small, are selected.

Figure 5B:
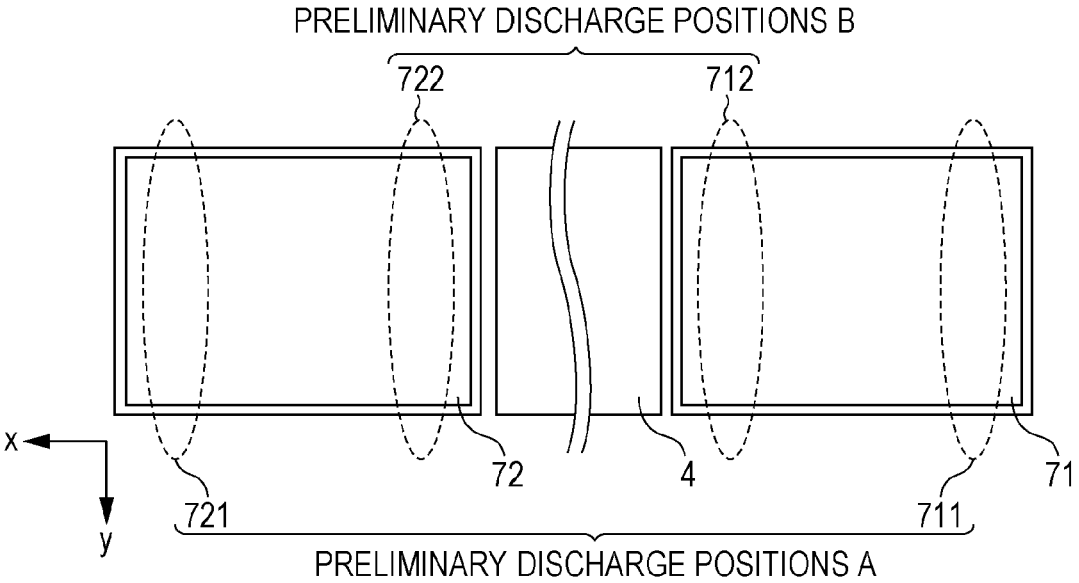
FIG. 5B is a top view illustrating preliminary discharge positions.

The preliminary discharge positions A and the preliminary discharge positions B will be described in detail with reference to FIG. 5B. FIG. 5B is a top view illustrating the preliminary discharge positions A and the preliminary discharge positions B. In the first preliminary discharge ink receiving portion 71, a position that is close to the recording area (the platen 4) is a preliminary discharge position 712, and a position that is far from the recording area (the platen 4) is a preliminary discharge position 711. In the second preliminary discharge ink receiving portion 72, a position that is close to the recording area (the platen 4) is a preliminary discharge position 722, and a position that is far from the recording area (the platen 4) is a preliminary discharge position 721. The above-mentioned preliminary discharge positions A refer to the preliminary discharge positions 711 and 721. The above-mentioned preliminary discharge positions B refer to the preliminary discharge positions 712 and 722. Note that, although an example in which the preliminary discharge positions 711 and 712 are formed in the same first preliminary discharge ink receiving portion 71, and the preliminary discharge positions 712 and 722 are formed in the same second preliminary discharge ink receiving portion 72 has been described, a configuration in which an additional preliminary discharge ink receiving portion is provided may be employed.

An example in which the distance d1 and the distance d2 respectively have a relationship of d1<D and a relationship of d2≥D in FIG. 3 will now be described. Regarding a preliminary discharge operation that is to be performed in the first preliminary discharge ink receiving portion 71, according to the flowchart of FIG. 5A, in the case where the leading end of the recording medium 1 is located on the platen 4 when a preliminary discharge operation is performed, the preliminary discharge operation is performed at the preliminary discharge position 711 that is far from one of the ends of the recording medium 1 by a distance larger than the threshold D. In the case where the leading end of the recording medium 1 is not located on the platen 4 when a preliminary discharge operation is performed, the preliminary discharge operation is performed at the preliminary discharge position 712 that is closest to the recording area. Regarding a preliminary discharge operation that is to be performed in the second preliminary discharge ink receiving portion 72, since the position of the second preliminary discharge ink receiving portion 72 is far from one of the ends of the recording medium 1 by a distance larger than the threshold D, a preliminary discharge operation is performed at the preliminary discharge position 722 that is closest to the recording area regardless of the position of the leading end of the recording medium 1 when the preliminary discharge operation is performed. In the case where the recording medium 1 is held on the platen 4 by the suction pump 9, the above-described threshold D is at least 50 mm and may be about 60 mm or larger.

It is known that, in the case where a recording medium is held on a platen by a suction pump, the recording medium is more susceptible to the influence of ink mist that is generated as a result of a preliminary discharge operation than in the case where the recording medium is not held on the platen. This is because ink mist that is generated as a result of a preliminary discharge operation is drawn in such a manner as to be guided by air flow that is generated by a suction pump that is used for causing a recording medium to be held on a platen. In other words, when ink mist is drawn by a plurality of suction ports, it is very likely that part of the ink mist is attached to the rear surface of a recording medium, and thus, back staining of a recording medium is more likely to occur. Therefore, the threshold D in the case where the recording medium is held on the platen is larger than the threshold D in the case where the recording medium is not held on the platen.

Although the ink jet recording apparatus that includes two preliminary discharge ink receiving portions has been described in the present embodiment, the number of preliminary discharge ink receiving portions may be one. In addition, preliminary discharge positions may be determined by not performing the determination in S1 using the threshold D but performing only the determination in S2 of whether or not the leading end of a recording medium is located on a platen.

Note that such a process of determining preliminary discharge positions can also be applied not only to a large ink jet recording apparatus, which performs a recording operation on an A1 recording medium or an A0 recording medium, but also to a business printer, which performs a recording operation on various recording media such as an A3 format recording medium, an A4 format recording medium, a recording medium that is smaller than A4 format recording media, and the like.

In the case of a cut recording medium, there is a possibility of the influence of back staining due to ink mist occurring also when the trailing end of the recording medium is located on a platen. This is because when the trailing end of the recording medium is located on the platen, a recording operation and a preliminary discharge operation are performed in a state where the recording medium is nipped only by the sheet ejection rollers 12, and also because of the influence of the curl of the recording medium. In other words, in the case of a cut recording medium, there is a possibility of a gap being generated between the recording medium and a platen when a trailing end of the recording medium is located on the platen, and thus, a preliminary discharge operation may be controlled in such a manner as to be performed at a position that is far from one of the ends of the recording medium by a distance larger than the threshold D.

Preliminary discharge positions are determined in the manner described above, so that an ink jet recording apparatus capable of preventing back staining of a recording medium from occurring while reducing a decrease in throughput can be provided.

Second Embodiment

Although an example in which a distance d from a left end of a recording medium to one of preliminary discharge ink receiving portions and a distance d from a right end of the recording medium to the other one of the preliminary discharge ink receiving portions are different from each other has been described in the first embodiment, an example in which a distance d from a left end of a recording medium to one of preliminary discharge ink receiving portions and a distance d from a right end of the recording medium to the other one of the preliminary discharge ink receiving portions are the same as each other will be described in the present embodiment.

Figure 6:
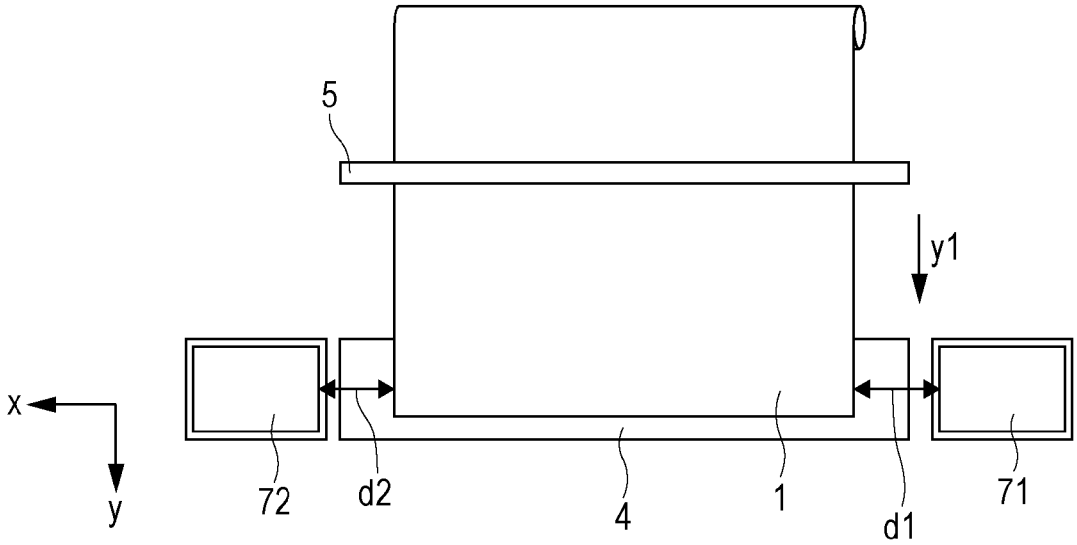
FIG. 6 is a top view schematically illustrating an ink jet recording apparatus according to a second embodiment.

FIG. 6 is a schematic top view of an ink jet recording apparatus that includes preliminary discharge ink receiving portions. Similarly to as in the first embodiment, the distance from one of ends of the recording medium 1 to an end of the first preliminary discharge ink receiving portion 71 with respect to the x direction is indicated by a reference numeral d1, and the distance from the other one of the ends of the recording medium 1 to an end of the second preliminary discharge ink receiving portion 72 with respect to the x direction is indicated by a reference numeral d2. In addition, in the present embodiment, the first preliminary discharge ink receiving portion 71 and the second preliminary discharge ink receiving portion 72 are disposed in such a manner as to have a relationship of d1=d2.

Also in this case, preliminary discharge positions can be determined by using the flowchart of FIG. 5A. Note that, since the distance d1 and the distance d2 are the same as each other in the present embodiment, both preliminary discharge positions can be determined by performing preliminary discharge position determination control once.

Next, an example in which d1 and d2 have a relationship of d1=d2<D in FIG. 6 will be described. Regarding a preliminary discharge operation that is to be performed in the first preliminary discharge ink receiving portion 71 and the second preliminary discharge ink receiving portion 72, according to FIG. 5A, in the case where the leading end of the recording medium 1 is located on the platen 4 when a preliminary discharge operation is performed, the preliminary discharge operation is performed at the preliminary discharge positions 712 and 722 each of which is far from a corresponding one of ends of the recording medium 1 by a distance larger than the threshold D. In the case where the leading end of the recording medium 1 is not located on the platen 4 when a preliminary discharge operation is performed, the preliminary discharge operation is performed at the preliminary discharge positioned 711 and 721. Note that the relationship of d1, d2, and D is merely an example, and the present embodiment is not limited to this.

Preliminary discharge positions are determined in the manner described above, so that an ink jet recording apparatus capable of preventing back staining of a recording medium from occurring while reducing a decrease in throughput can be provided.

Third Embodiment

Figure 7A:
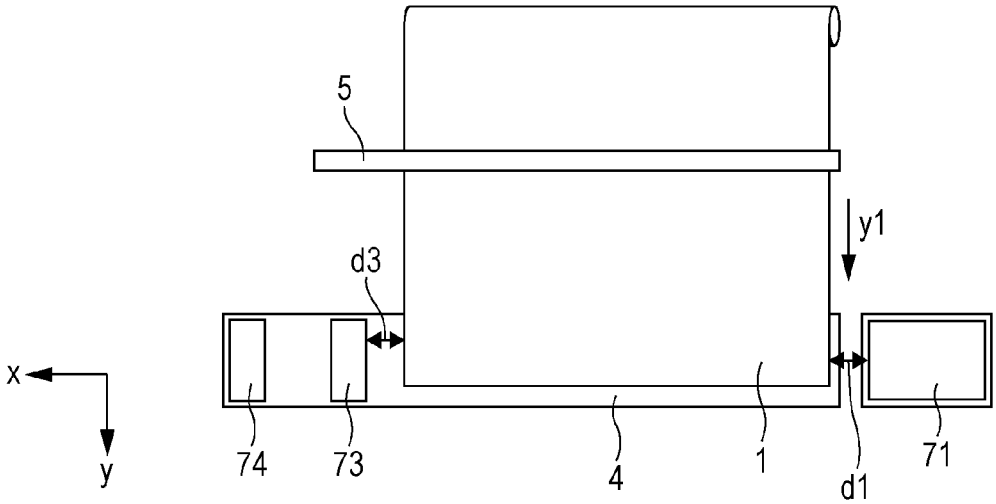
FIG. 7A is a top view schematically illustrating an ink jet recording apparatus according to a third embodiment.

In a third embodiment, an example in which a plurality of preliminary discharge ink receiving portions are provided on a platen will be described. FIG. 7A is a schematic top view of a main body of an ink jet recording apparatus according to the present embodiment.

In FIG. 7A, the first preliminary discharge ink receiving portion 71, a third preliminary discharge ink receiving portion 73, a fourth preliminary discharge ink receiving portion 74 are disposed outside an area in which a recording operation is performed on a recording medium. More specifically, the first preliminary discharge ink receiving portion 71 is disposed in one of areas that are outside the recording area, and the third preliminary discharge ink receiving portion 73 and the fourth preliminary discharge ink receiving portion 74 are disposed in the other one of the areas that is on the platen 4. The recording medium 1 is interposed between the areas. Note that the number of the preliminary discharge ink receiving portions is not limited to three. Here, the distance from one of ends of the recording medium to the first preliminary discharge ink receiving portion 71 with respect to the x direction is indicated by a reference numeral d1, and the distance from the other one of the ends of the recording medium 1 to the third preliminary discharge ink receiving portion 73 with respect to the x direction is indicated by a reference numeral d3.

Also in this case, preliminary discharge positions can be determined by using the flowchart of FIG. 5A.

Figure 7B:
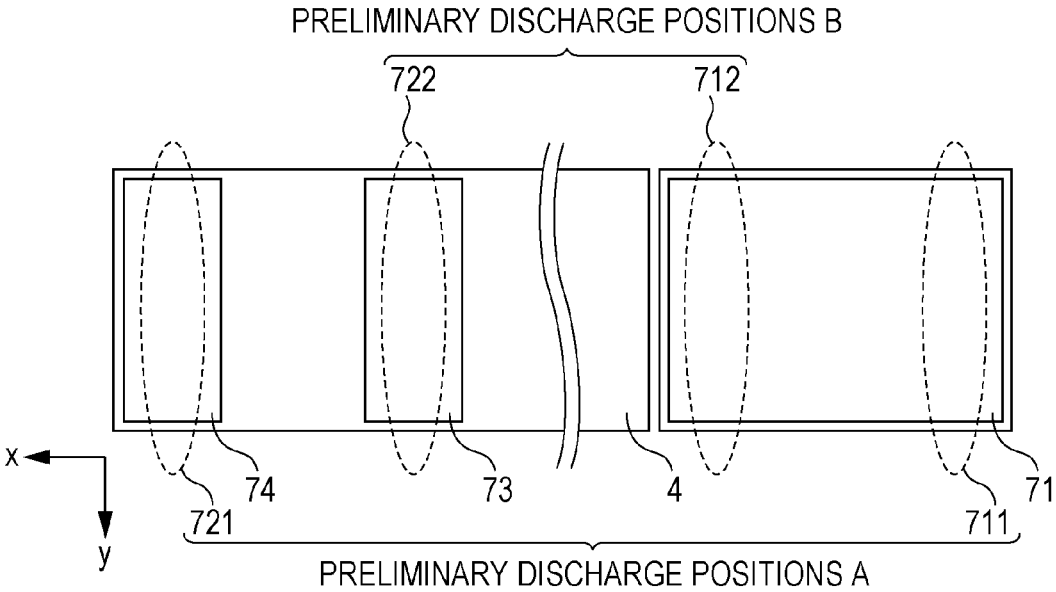
FIG. 7B is a top view illustrating preliminary discharge positions.

The preliminary discharge positions A and preliminary discharge positions B will be described in detail with reference to FIG. 7B. FIG. 7B is a top view illustrating the first preliminary discharge ink receiving portion 71, the third preliminary discharge ink receiving portion 73, and the fourth preliminary discharge ink receiving portion 74. In the first preliminary discharge ink receiving portion 71, a position that is close to a recording area (the platen 4) is a preliminary discharge position 712, and a position that is far from the recording area (the platen 4) is a preliminary discharge position 711. The third preliminary discharge ink receiving portion 73 that is disposed at a position that is close to the recording area (the platen 4) is the preliminary discharge position 722. The fourth preliminary discharge ink receiving portion 74 that is disposed at a position that is far from the recording area (the platen 4) is the preliminary discharge position 721. The above-mentioned preliminary discharge positions A refer to the preliminary discharge positions 711 and 721, and the above-mentioned preliminary discharge positions B refer to the preliminary discharge positions 712 and 722. An example in which d1 and d3 in FIG. 7A respectively have a relationship of d1<D and a relationship of d3<D will be described. Regarding a preliminary discharge operation that is to be performed in the preliminary discharge ink receiving portions, according to FIG. 5A, in the case where the leading end of the recording medium 1 is located on the platen 4 when a preliminary discharge operation is performed, the preliminary discharge operation is performed at the preliminary discharge position 711 and the preliminary discharge position 721 (the fourth preliminary discharge ink receiving portion 74). In the case where the leading end of the recording medium 1 is not located on the platen 4 when a preliminary discharge operation is performed, the preliminary discharge operation is performed at the preliminary discharge position 712 and the preliminary discharge position 722 (the third preliminary discharge ink receiving portion 73). Note that the relationship of d1, d3, and D is merely an example, and the present embodiment is not limited to this.

Preliminary discharge positions are determined in the manner described above, so that an ink jet recording apparatus capable of preventing back staining of a recording medium from occurring while reducing a decrease in throughput can be provided.

Fourth Embodiment

In a fourth embodiment, an example of preliminary discharge position determination control in the case where a transportation amount of a recording medium (a line feed amount) is not constant in a series of recording operations will be described. In the case where the transportation amount in a single operation is small, the same portion of the recording medium 1 remains in an area that is influenced by ink mist, which is generated as a result of a preliminary discharge operation, for longer periods of time as compared with the case where the transportation amount in a single operation is large. In the studies that were conducted by the inventors, it was found that, as a result, back staining occurs more notably due to the influence of ink mist.

Figure 8A:
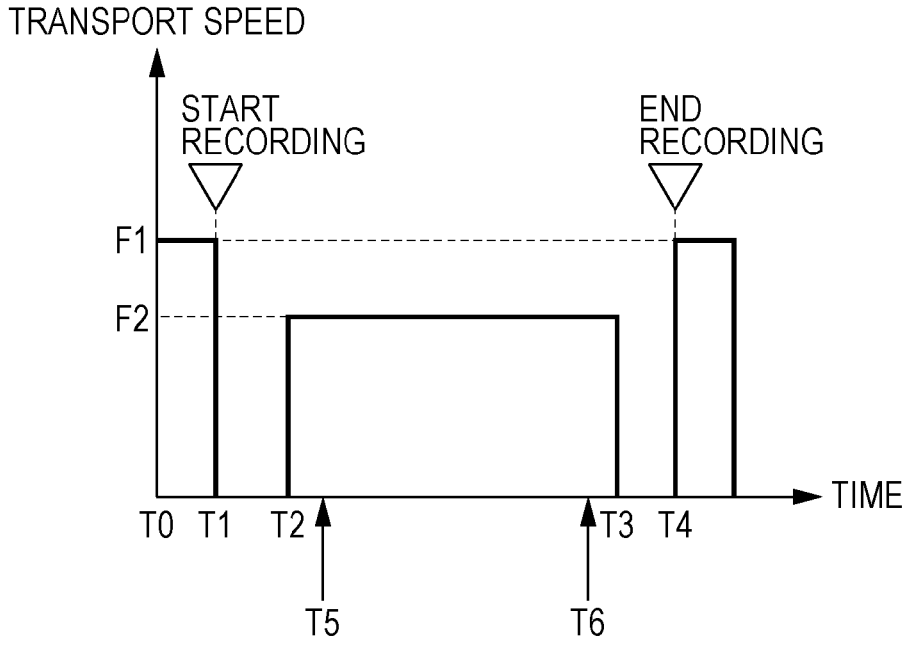
FIG. 8A is a conceptual diagram of transport speed with time for a recording operation according to a fourth embodiment.
Figure 8B:
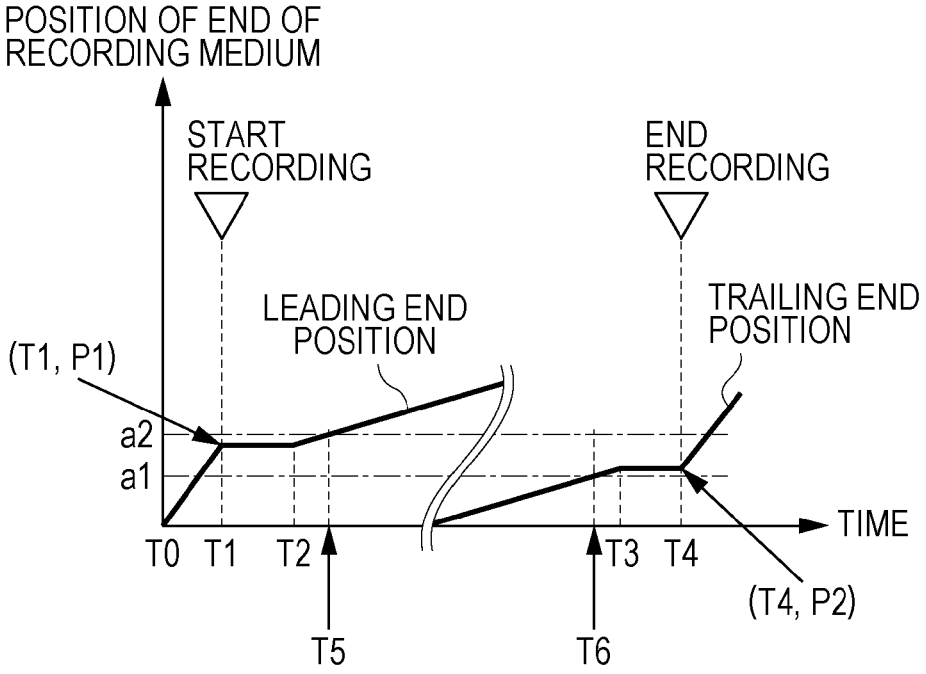
FIG. 8B is a conceptual diagram illustrating positions of ends of a recording medium with time for the recording operation.

FIG. 8A is a conceptual diagram of transport speed with time for a series of recording operations. FIG. 8B is a conceptual diagram illustrating the positions of ends of the recording medium (the positions of the leading end and the trailing end) with time for a series of recording operations.

In FIG. 8A, transportation of the recording medium 1 at a transport speed F1 (inches/sec) is started at time T0, and transportation of the recording medium 1 to a recording start position is completed at time T1. A recording operation is performed during the period from time T1 to time T4. The recording medium 1 is not transported during the period from time T1 to time T2 and the period from time T3 to time T4 (the transport speed is zero), and a recording operation is performed by discharging ink from a recording head. The recording medium 1 is transported at a transport speed F2 (inches/sec) during the period from time T2 to time T3. Note that, here, the relationship between time and transport speed is merely an example, and the present embodiment is not limited to this. In addition, the transport speed is not constant due to the effect of starting up a motor.

In FIG. 8B, the range from a1 to a2 is the range in which the leading end of the recording medium 1 is located on the platen 4. Transportation of the recording medium 1 is started at time T0, the leading end of the recording medium 1 reaches a position P1 on the platen 4 at time T1, and after that, the leading end of the recording medium 1 remains at the position P1 until time T2. Next, transportation of the recording medium 1 is started again at time T2, and the leading end of the recording medium 1 is located out of the platen 4 after time T5. The trailing end of the recording medium 1 is located on the platen 4 at time T6. The trailing end of the recording medium 1 reaches a position P2, and after that, the trailing end of the recording medium 1 remains at the position P2 until time T4.

Determination of preliminary discharge positions in the above-described operation will be described in detail with reference to FIGS. 9A and 9B.

Figure 9A:
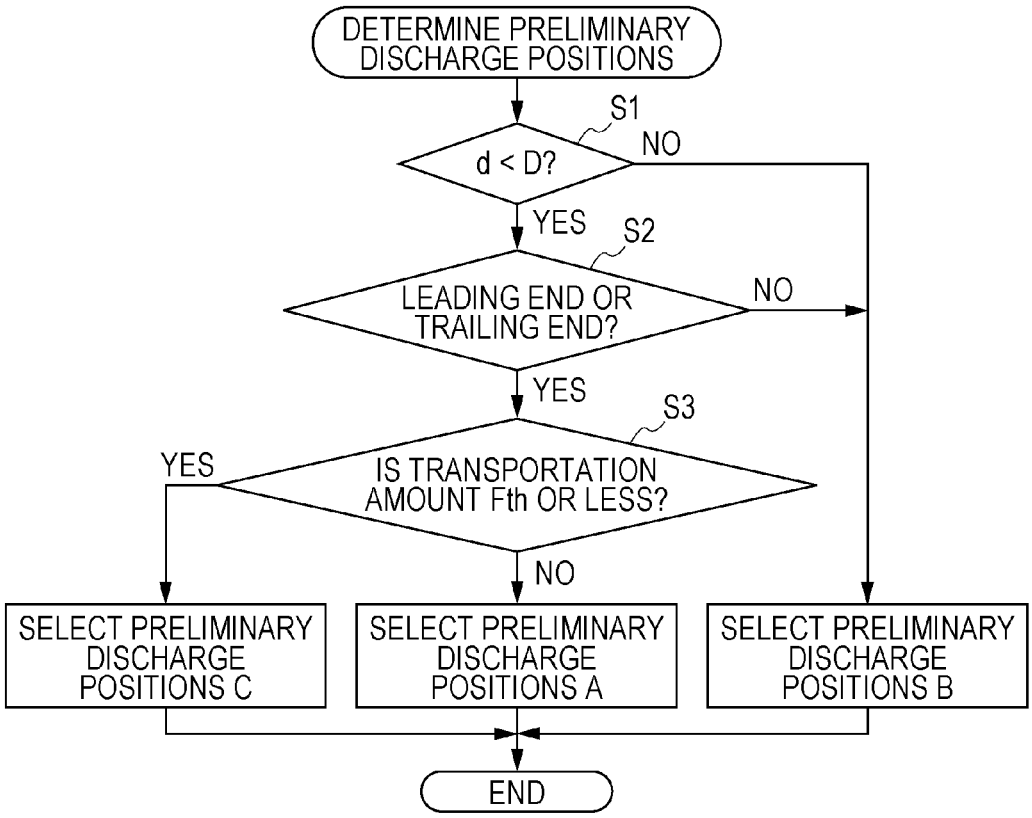
FIG. 9A is a flowchart of a process of determining preliminary discharge positions.
Figure 9B:
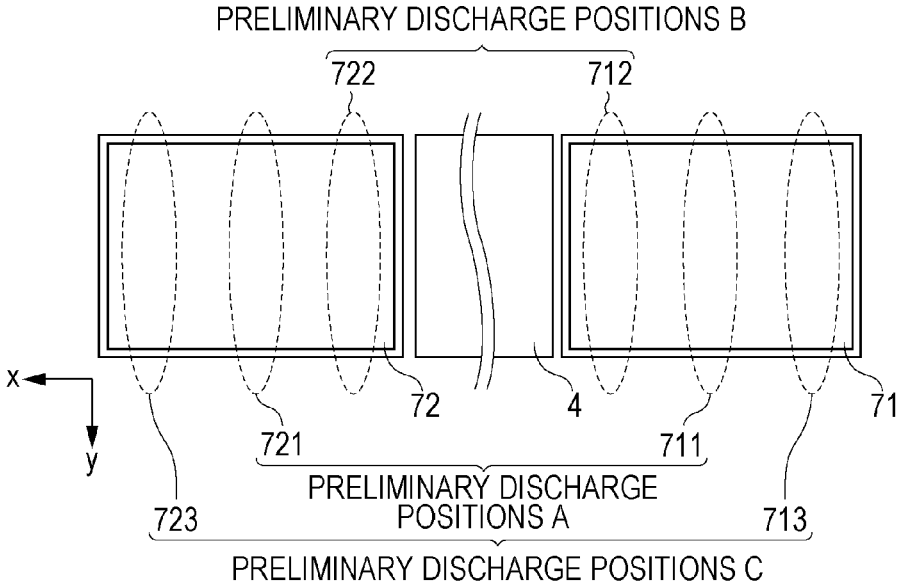
FIG. 9B is a top view illustrating preliminary discharge positions.

FIG. 9A is a diagram illustrating a flow of determination of preliminary discharge positions.

First, when preliminary discharge position determination control is started, the distance d from an end of a recording medium and an end of a preliminary discharge ink receiving portion, on which a preliminary discharge operation will be performed, with respect to the x direction is compared with a threshold D (a predetermined value) (S1). Here, the threshold D indicates a minimum distance at which ink mist that is generated as a result of a preliminary discharge operation will not be dispersed on the backside of the recording medium even in an area in a leading end portion of the recording medium in which a gap is generated between the recording medium and a platen.

When the distance d is smaller than the threshold D (d<D) in S1, it is determined that there is a possibility of back staining occurring when a preliminary discharge operation is performed at a position in the preliminary discharge ink receiving portion that is closest to the recording medium, and the process moves on to S2. When the distance d is not smaller than the threshold D (dD), it is determined that back staining will not occur even if a preliminary discharge operation is performed at any position in the preliminary discharge ink receiving portion, and preliminary discharge positions B that are close to ends of the recording medium are selected in order to reduce a decrease in throughput.

In S2, it is determined whether or not the leading end or the trailing end of the recording medium 1 is located on the platen 4 when a preliminary discharge operation is performed. Information of the positions of the leading end and the trailing end of the recording medium 1 with respect to the transport direction can be determined by using the timing when the leading end of the recording medium 1 is sensed by the end-position sensor 10. More specifically, the information of the positions of the leading end and the trailing end of the recording medium 1 with respect to the transport direction can be determined from a rotation amount of the transport rollers 5 after the leading end of the recording medium 1 has been sensed.

In S2, in the case where it is determined that the leading end or the trailing end of the recording medium 1 is located on the platen 4, the process moves on to S3. In the case where it is determined that the leading end or the trailing end of the recording medium 1 is not located on the platen 4, the preliminary discharge positions B are selected.

In S3, it is determined whether or not a transportation amount (a line feed amount) is not more than a transportation amount threshold Fth.

In the case where it is determined that the transportation amount is larger than the transportation amount threshold Fth, preliminary discharge positions A each of which is far from a corresponding one of ends of the recording medium by a distance larger than the threshold D are selected in order to suppress occurrence of back staining.

In the case where it is determined that the transportation amount is not larger than the transportation amount threshold Fth, preliminary discharge positions C that are farther from a recording area than the preliminary discharge positions A are selected. The preliminary discharge positions C are positions at which the influence of ink mist that is dispersed on the backside of the recording medium 1 can be ignored even when a recording operation is performed in a state where the transportation amount is not larger than the transportation amount threshold Fth.

In other words, in the case where an end of the recording medium is located on the platen, preliminary discharge positions may be determined with consideration of a transportation amount (a line feed amount).

The preliminary discharge positions A, B, and C will be described in detail with reference to FIG. 9B. FIG. 9B is a top view illustrating the first preliminary discharge ink receiving portion 71 and the second preliminary discharge ink receiving portion 72. In the first preliminary discharge ink receiving portion 71, the preliminary discharge positions 712, 711, and 713 are formed in this order from the side of the recording area (the platen 4).

In the second preliminary discharge ink receiving portion 72, the preliminary discharge positions 722, 721, and 723 are formed in this order from the side of a recording area (the platen 4). The above-described preliminary discharge positions A refer to the preliminary discharge positions 711 and 721. The preliminary discharge positions B refer to the preliminary discharge positions 712 and 722, and the preliminary discharge positions C refer to the preliminary discharge positions 713 and 723. Note that, although an example in which the preliminary discharge positions 711, 712, and 713 are formed in the same first preliminary discharge ink receiving portion 71, and the preliminary discharge position 721, 722, and 723 are formed in the same second preliminary discharge ink receiving portion 72 has been described, a configuration in which an additional preliminary discharge ink receiving portion is provided may be employed.

According to the flowchart of FIG. 9A, in FIGS. 8A and 8B, the preliminary discharge positions C are selected during the period from time T1 to time T2, the preliminary discharge positions A are selected during the period from time T2 to time T5, and the preliminary discharge positions B are selected during the period from time T5 to time T6. The preliminary discharge positions A are selected during the period from time T6 to time T3, and the preliminary discharge positions C are selected during the period from time T3 to time T4.

Preliminary discharge positions are determined in the manner described above, so that an ink jet recording apparatus capable of preventing back staining of a recording medium from occurring while reducing a decrease in throughput can be provided.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2013-090805, filed Apr. 23, 2013, which is hereby incorporated by reference wherein in its entirety.

What is claimed is:

1. An inkjet recording apparatus comprising:

a carriage that moves in a first direction and on which a recording head that performs recording by discharging ink is mounted;

a transport unit that transports a recording medium in a second direction that crosses the first direction;

a preliminary discharge unit configured to cause the recording head to perform a preliminary discharge operation; and a platen that supports the recording medium at a position facing the recording head, wherein the preliminary discharge unit executes a first preliminary discharge operation at a first position which is apart from a side end of the recording medium when a leading end or a trailing end of the recording medium is not located on the platen, and a second preliminary discharge operation at a second position which is further apart from the side end of the recording medium than the first position in the first direction when the leading end or the trailing end of the recording medium is located on the platen.

2. The inkjet recording apparatus according to claim 1, further comprising:

a detection unit that detects a position of the leading end or the trailing end of the recording medium, wherein the preliminary discharge unit executes the first preliminary discharge operation or the second preliminary discharge operation based on a detection result of the detection unit.

3. The inkjet recording apparatus according to claim 1, wherein the preliminary discharge unit executes the second preliminary discharge operation at a third position which is further apart from the side end of the recording medium than the second position in the first direction when a transportation amount of the recording medium is smaller than a predetermined amount.

4. The inkjet recording apparatus according to claim 1, further comprising:

a preliminary discharge receiving portion that receives ink that is preliminary discharged from the recording head, wherein the first position and the second position are provided in the preliminary discharge receiving portion.

5. The inkjet recording apparatus according to claim 1, further comprising:

a first preliminary discharge receiving portions that receive ink that is preliminary discharged from the recording head at the first position; and a second preliminary discharge receiving portion that receives ink that is preliminary discharged from the recording head at the second position.

6. The inkjet recording apparatus according to claim 1, further comprising:

a suction unit that causes a recording medium to be held on the platen.

7. The inkjet recording apparatus according to claim 6, wherein the preliminary discharge unit executes the second preliminary discharge operation at a forth position which is further apart from the side end of the recording medium than the second position in the first direction when the recording medium is held on the platen by the suction unit.

* * * * *